US005109935A

United States Patent [19]

Hawke

[11] Patent Number: 5,109,935

[45] Date of Patent: May 5, 1992

[54] ROTARY DRILL BITS

[75] Inventor: Leslie R. Hawke, Stroud, England

[73] Assignee: Reed Tool Company Limited, Stonehouse, England

[21] Appl. No.: 616,636

[22] Filed: Nov. 21, 1990

[30] Foreign Application Priority Data

Nov. 25, 1989 [GB] United Kingdom ..... 8926689

[51] Int. Cl.[5] ..... E21B 10/46

[52] U.S. Cl. ..... 175/434; 175/399; 175/408

[58] Field of Search ..... 175/336, 371, 376, 343, 175/329, 398, 399, 408, 410, 325

[56] References Cited

U.S. PATENT DOCUMENTS 4,220,213 9/1980 Hamilton ..... 175/325 X
4,982,802 1/1991 Warren et al. ..... 175/399 X

FOREIGN PATENT DOCUMENTS 0384734 8/1990 European Pat. Off. .

OTHER PUBLICATIONS

"Bit Whirl—A New Theory of PDC Bit Failure", paper No. SPE 15971, by J. F. Brett, T. M. Warren and S. M. Behr, Society of Petroleum Engineers, 64th Annual Technical Conference, San Antonio, Tex., Oct. 8-11, 1989.

"Development of a Whirl Resistant Bit", paper No. 19572, by T. M. Warren, Society of Petroleum Engineers, 64th Annual Technical Conference, San Antonio, Tex., Oct. 8-11, 1989.

*Primary Examiner*—Stephen J. Novosad
*Attorney, Agent, or Firm*—Browning, Bushman, Anderson & Brookhart

[57] ABSTRACT

A rotary drill bit comprises a bit body having a shank for connection to a drill string and a passage for supplying drilling fluid to the face of the bit, which carries a plurality of polycrystalline diamond preform cutting elements. In order to reduce bit whirl, the cutting elements are so disposed as to apply a resultant lateral force to the bit as it rotates during drilling, and the gauge of the bit body is provided with low friction bearing means to transmit said resultant force to the sides of the borehole. Each low friction bearing means includes a roller mounted on the bit body for rotation about an axis parallel to the axis of rotation of the bit, each roller being so disposed that its periphery bears on the formation as the bit rotates.

4 Claims, 1 Drawing Sheet

ROTARY DRILL BITS

BACKGROUND OF THE INVENTION

The invention relates to rotary drill bits for use in drilling or coring holes in subsurface formations, and particularly to polycrystalline diamond compact (PDC) drag bits.

A rotary drill bit of the kind to which the present invention relates comprises a bit body having a shank for connection to a drill string and a passage for supplying drilling fluid to the face of the bit, which carries a plurality of preform cutting elements each formed, at least in part, from polycrystalline diamond. One common form of cutting element comprises a tablet, usually circular or part-circular, made up of a superhard table of polycrystalline diamond, providing the front cutting face of the element, bonded to a substrate which is usually of cemented tungsten carbide.

The bit body may be machined from solid metal, usually steel, or may be moulded using a powder metallurgy process in which tungsten carbide powder is infiltrated with metal alloy binder in a furnace so as to form a hard matrix.

While such PDC bits have been very successful in drilling relatively soft formations, they have been less successful in drilling harder formations and soft formations which include harder occlusions or stringers. Although good rates of penetration are possible in harder formations, the PDC cutters suffer accelerated wear and bit life can be too short to be commercially acceptable.

Recent studies have suggested that the rapid wear of PDC bits in harder formations is due to chipping of the cutters as a result of impact loads caused by vibration, and that the most harmful vibrations can be attributed to a phenomenon called "bit whirl". ("Bit Whirl—A New Theory of PDC Bit Failure"—paper No. SPE 15971 by J. F. Brett, T. M. Warren and S. M. Behr, Society of Petroleum Engineers , 64th Annual Technical Conference, San Antonio, Oct. 8–11, 1989). Bit whirl arises when the instantaneous axis of rotation of the bit precesses around the central axis of the hole when the diameter of the hole becomes slightly larger than the diameter of the bit. When a bit begins to whirl some cutters can be moving sideways or backwards relatively to the formation and may be moving at much greater velocity than if the bit were rotating truly. Once bit whirl has been initiated, it is difficult to stop since the forces resulting from the bit whirl, such as centrifugal forces, tend to reinforce the effect.

Attempts to inhibit the initiation of bit whirl by constraining the bit to rotate truly, i.e. with the axis of rotation of the bit coincident with the central axis of the hole, have not been particularly successful.

Although it is normally considered desirable for PDC drill bits to be rotationally balanced, in practice some imbalance is tolerated. Accordingly it is fairly common for PDC drill bits to be inherently imbalanced, i.e. when the bit is being run there is, due to the cutting, hydraulic and centrifugal forces acting on the bit, a resultant force acting on the bit, the lateral component of which force, during drilling, is balanced by an equal and opposite reaction from the sides of the borehole.

This resultant lateral force is commonly referred to as the bit imbalance force and is usually represented to as a percentage of the weight-on-bit since it is almost directly proportional to weight-on-bit. It has been found that certain imbalanced bits are less susceptible to bit whirl than other, more balanced bits. ("Development of a Whirl Resistant Bit"—paper No. SPE 19572 by T. M. Warren, Society of Petroleum Engineers, 64th Annual Technical Conference, San Antonio, Oct. 8–11, 1989). Investigation of this phenomenon has suggested that in such less susceptible bits the resultant lateral imbalance force is directed towards a portion of the bit gauge which happens to be free of cutters and which is therefore making lower "frictional" contact with the formation than other parts of the gauge of the bit on which face gauge cutters are mounted. It is believed that, since a comparatively low friction part of the bit is being urged against the formation by the imbalance force, slipping occurs between this part of the bit and the formation and the rotating bit therefore has less tendency to precess, or "walk", around the hole, thus initiating bit whirl.

(Although, for convenience, reference is made herein to "frictional" contact between the bit gauge and formation, this expression is not intended to be limited only to rubbing contact, but should be understood to include any form of engagement between the bit gauge and formation which applies a restraining force to rotation of the bit. Thus, it is intended to include, for example, engagement of the formation by any cutters or abrasion elements which may be mounted on the part of the gauge being referred to.)

This has led to the suggestion, in the above-mentioned paper by Warren, that bit whirl might be reduced by omitting cutters from one sector of the bit face, so as deliberately to imbalance the bit, and providing a low friction pad on the bit body for engaging the surface of the formation in the region towards which the resultant lateral force due to the imbalance is directed.

Experimental results have indicated that this approach may be advantageous in reducing or eliminating bit whirl. However, the omission of cutters from one sector of a PDC bit can have disadvantages, and our co-pending British Patent Application No. 8926688-6 discloses some alternative and preferred arrangements for providing the necessary imbalance in the bit in an arrangement for reducing or eliminating bit whirl. The present invention relates to arrangements for providing the necessary low friction means on the bit body. The arrangements to be described may provide a low friction means for use with any method of providing the imbalance force, including but not restricted to those arrangements disclosed in the above mentioned co-pending application.

SUMMARY OF THE INVENTION

According to the invention there is provided a rotary drill bit comprising a bit body having a shank for connection to a drill string and a passage for supplying drilling fluid to the face of the bit, which carries a plurality of preform cutting elements each formed, at least in part, from polycrystalline diamond, the bit including means to apply a resultant lateral force to the bit as it rotates in use, and the gauge of the bit body including at least one low friction bearing means so located as to transmit said resultant lateral force to the part of the formation which the bearing means is for the time being engaging, the low friction bearing means including at least one roller mounted on the bit body for rotation about an axis lying in a plane containing the central axis of rotation of the bit and disposed so that a portion of the periphery of the roller engages the formation as the bit rotates.

The axis of rotation of the roller may extend substantially parallel to the central axis of rotation of the bit.

Preferably there is provided a second roller so located as to transmit part of said resultant lateral force to the formation. In this case the axes of rotation of the two rollers are preferably angularly spaced apart on the forward and rearward sides respectively of the direction of said resultant lateral imbalance force, in a plane transverse to the longitudinal axis of the drill bit. Preferably the axis of rotation of the roller on the forward side of the lateral imbalance force is angularly spaced from said direction by a lesser angle than is the axis of rotation of the roller on the rearward side of said direction. The angular spacing between the axes of the rollers is preferably in the range of about 60° to 120°, for example 90°.

DETAILED DESCRIPTION OF THE PREFERRED EMBODIMENT

Figure 1:
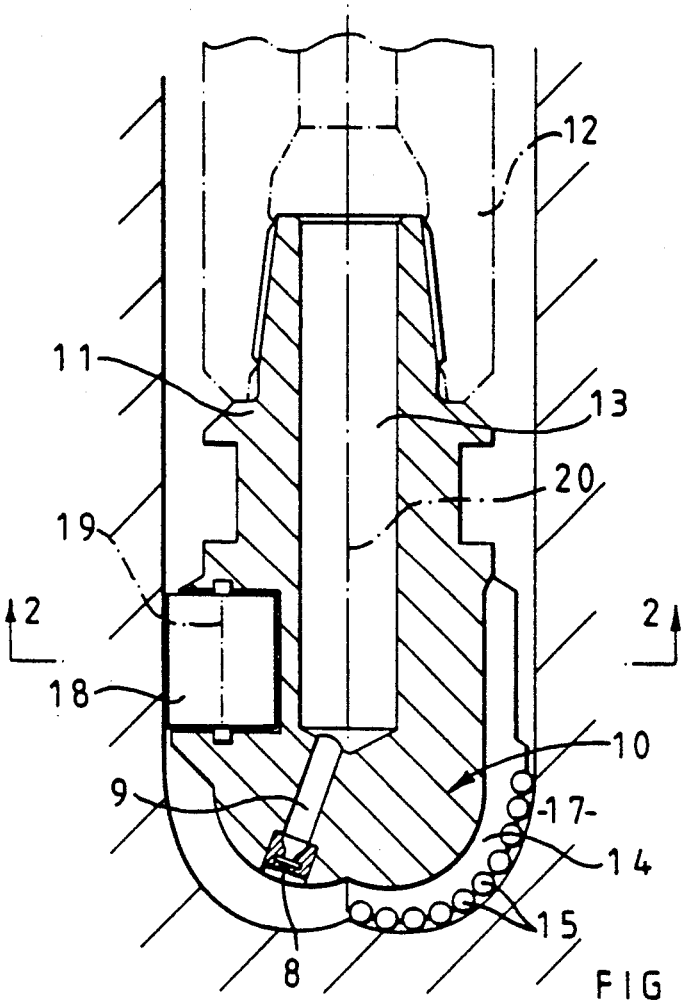
FIG. 1 is a diagrammatic longitudinal section through a PDC drill bit in accordance with the invention, the bit being shown at the bottom of a borehole.

Referring to the drawings: there is shown a rotary drill bit comprising a bit body 10 having a shank 11 for connection to a drill string 12 and a central passage 13 for supplying drilling fluid through bores 9 to nozzles 8 in the face of the bit.

The face of the bit is formed with at least one blade 14 which carries a plurality of preform cutting elements 15 each formed, at least in part, from polycrystalline diamond.

The bit is imbalanced, i.e. it is so designed that when the bit is being run there is a resultant lateral force acting sideways on the bit which, during drilling, is balanced by an equal and opposite reactive force from the walls of the borehole. In the bit shown in the drawings the imbalance force is provided by locating all the cutters 15 to one side of a diameter of the bit body, for example by providing cutters along only a single blade. The direction of the lateral component of the resultant force is indicated by the arrow 16 in FIG. 2. However, such a arrangement is described merely by way of example and any suitable means may be employed for achieving this lateral imbalance force and the present invention is not restricted to the use of any particular method of achieving such force.

In accordance with the previously mentioned concept of reducing or eliminating the bit whirl, the gauge portion of the bit body is provided with low friction bearing means to transmit the imbalance force 16 to the formation 17. In accordance with the present invention, the or each low friction bearing means comprises a roller.

In the particular arrangement shown in the drawings, there are provided two such rollers 18, each of which is carried in bearings (not shown) in the bit body and is rotatable relatively to the bit body about an axis 19 extending generally parallel to the central axis 20 of the bit. The peripheral surface of each roller 18 projects outwardly beyond the adjacent surfaces 21 of the bit body so as to engage the formation 17.

The rollers 18 therefore provide low friction bearing means since, as the drill bit rotates during drilling, the rollers 18 can roll around the surface of the formation, thus reducing or eliminating the tendency for the bit itself to precess or "walk" around the internal surface of the hole.

The surfaces of the rollers 18 themselves need not provide low frictional contact with the formation and are indeed preferably of higher friction than the rest of the bit gauge so as to increase the tendency of the rollers 18 to rotate relatively to the bit body rather than slipping across the surface of the formation.

The bit body is formed with kickers 22 disposed diametrically opposite the rollers 18 respectively to assist in guiding and stabilising the bit during tripping in and out of the borehole. As will be seen from FIG. 2, however, there is a gap between the kickers 22 and the walls of the borehole during drilling.

Although it is preferred to provide two rollers on the forward and rearward sides respectively of the direction of the imbalance force 16, as shown, any number of such rollers may be provided so long as they are so located as to transmit to the surface of the formation at least a portion of the lateral imbalance force acting on the bit during drilling.

Figure 2:
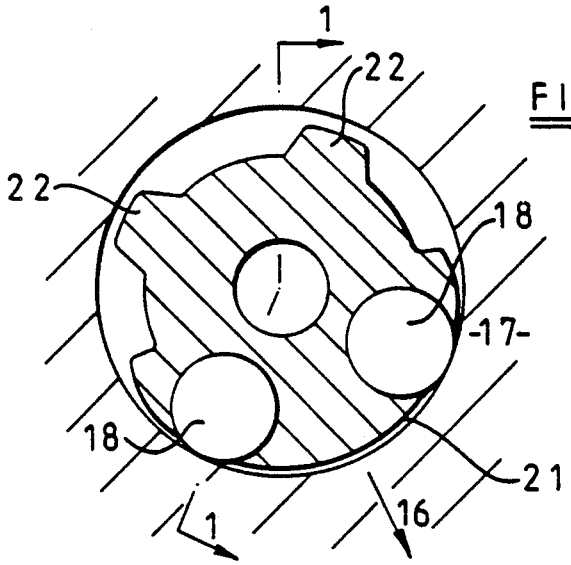
FIG. 2 is a horizontal section on the line 2—2 of FIG. 1.

In the arrangement of FIGS. 1 and 2 the axes of rotation of the two rollers 18 are angularly spaced apart by approximately 90°, although other angular spacings in the range of 60° to 120° may also be suitable. The angular spacing should be sufficient to allow for variations in the direction of the imbalance force 16 due, for example, to manufacturing tolerances and variation in operating conditions.

The rollers 18 are so disposed that the resultant of the reaction forces between the rollers and the walls of the borehole, during drilling, balances the lateral imbalance force 16 acting on the drill bit. Although frictional resistance will be small, each reaction force will include a small rearward tangential component. In view of this, therefore, the axes of the rollers are not symmetrically disposed with respect to the direction of the imbalance force 16 but are slightly displaced rearwardly from the symmetrical position. Accordingly, the axis of the roller 18 on the forward side of the direction of the imbalance force 16 is angularly displaced therefrom by a lesser angle than the axis of the rearward roller.

I claim:

1. A rotary drill bit comprising a bit body having a shank for connection to a drill string and a passage for supplying drilling fluid to the face of the bit, which carries a plurality of preform cutting elements each formed, at least in part, from polycrystalline diamond, the bit including means to apply a resultant lateral force to the bit as it rotates in use, and the gauge of the bit body including at least one low friction bearing means so located as to transmit said resultant lateral force to the part of the formation which the bearing means is for the time being engaging, the low friction bearing means including at least two rollers each mounted on the bit body for rotation about an axis lying in a plane containing the central axis of rotation of the bit and disposed so that a portion of the periphery of each roller engages the formation as the bit rotates and transmits a part of the resultant lateral force to the formation, wherein the axes of rotation of the two rollers are angularly spaced apart on the forward and rearward sides, respectively, with respect to the normal direction of forward rotation of the drill bit while drilling, of the direction of said resultant lateral imbalance force, in a plane transverse to the longitudinal axis of the drill bit, and wherein the axis of rotation of the roller on the forward side of the lateral imbalance force is angularly spaced from said direction by a lesser angle than is the axis of rotation of the roller on the rearward side of said direction.

2. A rotary drill bit according to claim 1, wherein the axes of rotation of the rollers extend substantially parallel to the central axis of rotation of the bit.

3. A rotary drill bit according to claim 1, wherein the axes of rotation of the two rollers are angularly spaced apart, in a plane transverse to the longitudinal axis of the drill bit, by an angle in the range of about 60° to 120°.

4. A rotary drill bit according to claim 3, wherein the axes of rotation of the two rollers are angularly spaced apart by substantially 90°, in a plane transverse to the longitudinal axis of the drill bit.

* * * * *